US005738129A

United States Patent [19]

Vogt

[11] Patent Number: 5,738,129

[45] Date of Patent: Apr. 14, 1998

[54] RADIAL FOLDING UMBRELLA

[76] Inventor: Wolfgang Vogt, 12529 27th Ave, Surrey, British Columbia, Canada, V4A 2M6

[21] Appl. No.: 820,839

[22] Filed: Mar. 20, 1997

Related U.S. Application Data

[60] Provisional application No. 60/013,815 Mar. 21, 1996.

[51] Int. Cl.[6] ..... A45B 19/00

[52] U.S. Cl. ..... 135/19.5; 135/20.1; 135/28

[58] Field of Search ..... 135/19, 19.5, 20.1, 135/28, 38, 39, 40, 41, 16, 15.1

[56] References Cited

U.S. PATENT DOCUMENTS

| | | | |
|---|---|---|---|
| 706,605 | 8/1902 | Slyder | 135/20.1 X |
| 1,328,902 | 1/1920 | Ryder | 135/20.1 |
| 1,349,281 | 8/1920 | King | 135/19.5 X |
| 2,465,140 | 3/1949 | Vila | 135/19.5 |
| 4,934,394 | 6/1990 | Hermanson | 135/19.5 |
| 5,263,505 | 11/1993 | Yeom | 135/28 X |

FOREIGN PATENT DOCUMENTS

| | | | |
|---|---|---|---|
| 0948421 | 8/1949 | France | 135/20.1 |
| 5583 | 8/1897 | Norway | 135/19.5 |
| 362871 | 6/1930 | United Kingdom | 135/19.5 |

*Primary Examiner*—Lanna Mai

*Attorney, Agent, or Firm*—Wolfgang Vogt

[57] ABSTRACT

An umbrella that folds in a radial manner and has a canopy supported by a shaft that has its vertical projection located outwardly from the fabric cover. The umbrella shaft extends from its vertical position to an almost horizontal position towards the center of the canopy, forming in effect one of the support ribs. The fabric cover is secured to the shaft by snaps, or a hook and loop fastener. Both ends of the fabric panel are attached to the shaft in a looped manner. The opening of the fabric is looped under the shaft to prevent water entry. Located at the end of the horizontal shaft is a vertical pin representing the center of the umbrella to which a plate pivotally attaches. A plurality of support ribs are pivotally connected to the plate and made of flexible material to prevent breakage during windy conditions. The folding mechanism allows for radial folding of all support ribs to be aligned with the supporting shaft.

1 Claim, 3 Drawing Sheets

RADIAL FOLDING UMBRELLA

This application is based on the provisional application Ser. No. 60/013,815 filed on Mar. 21, 1996.

FIELD OF INVENTION

This invention relates to umbrellas, specifically to a type that opens and closes in a radial manner, eliminating a centrally located support shaft.

BACKGROUND OF INVENTION

In the past, protection from the sun and rain has been provided by the use of conventional umbrellas. Garden umbrellas with a central support shaft do not provide the freedom of movement necessary in certain applications, such as over hot tubs and spas. Attempts have been made to provide umbrellas that eliminate a central support shaft. Those attempts have resulted in a complicated mechanism that is expensive to manufacture. Such umbrellas are heavy and cumbersome and are not considered for multiple use, nor are they considered portable.

OBJECTS AND ADVANTAGES

The object is to provide an umbrella of a larger size with unobstructed free space beneath it. Further objects and advantages are to provide an umbrella that:

(a) is made of few, inexpensive, simple, rugged and reliable parts which are easy to manufacture and assemble;

(b) offers portability, thereby facilitating use in different applications such as garden umbrellas, for use over hot tubs and spas, mounted on motorhomes and horse trailers;

(c) offers high degree of safety from damage due to strong winds without the intervention of a person.

Various other uses and applications are within the scope of this invention, such as the use as light reflectors by photographers or film crews.

DETAILED DESCRIPTION OF THE STRUCTURE OF THE INVENTION'S MAIN EMBODIMENT

Figure 1:
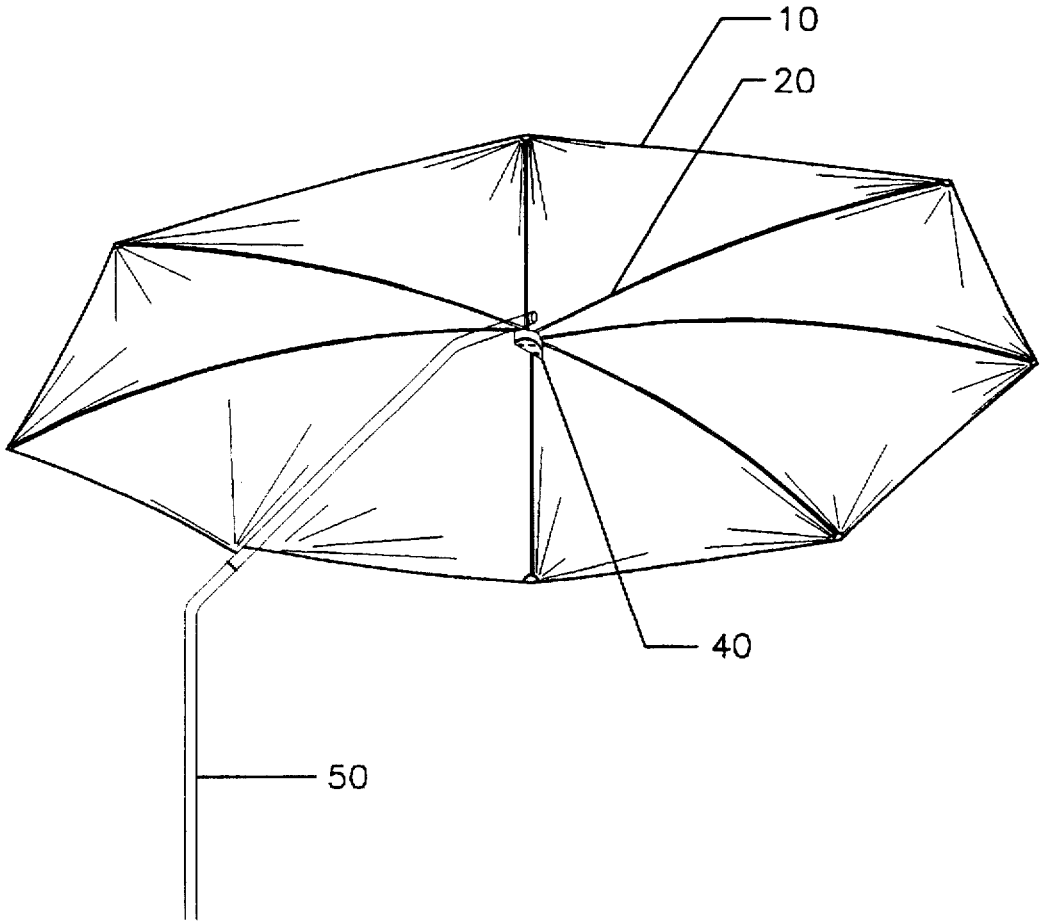
FIG. 1 shows the umbrella in an open position with its supporting shaft and its plate for supporting ribs.
Figure 2:
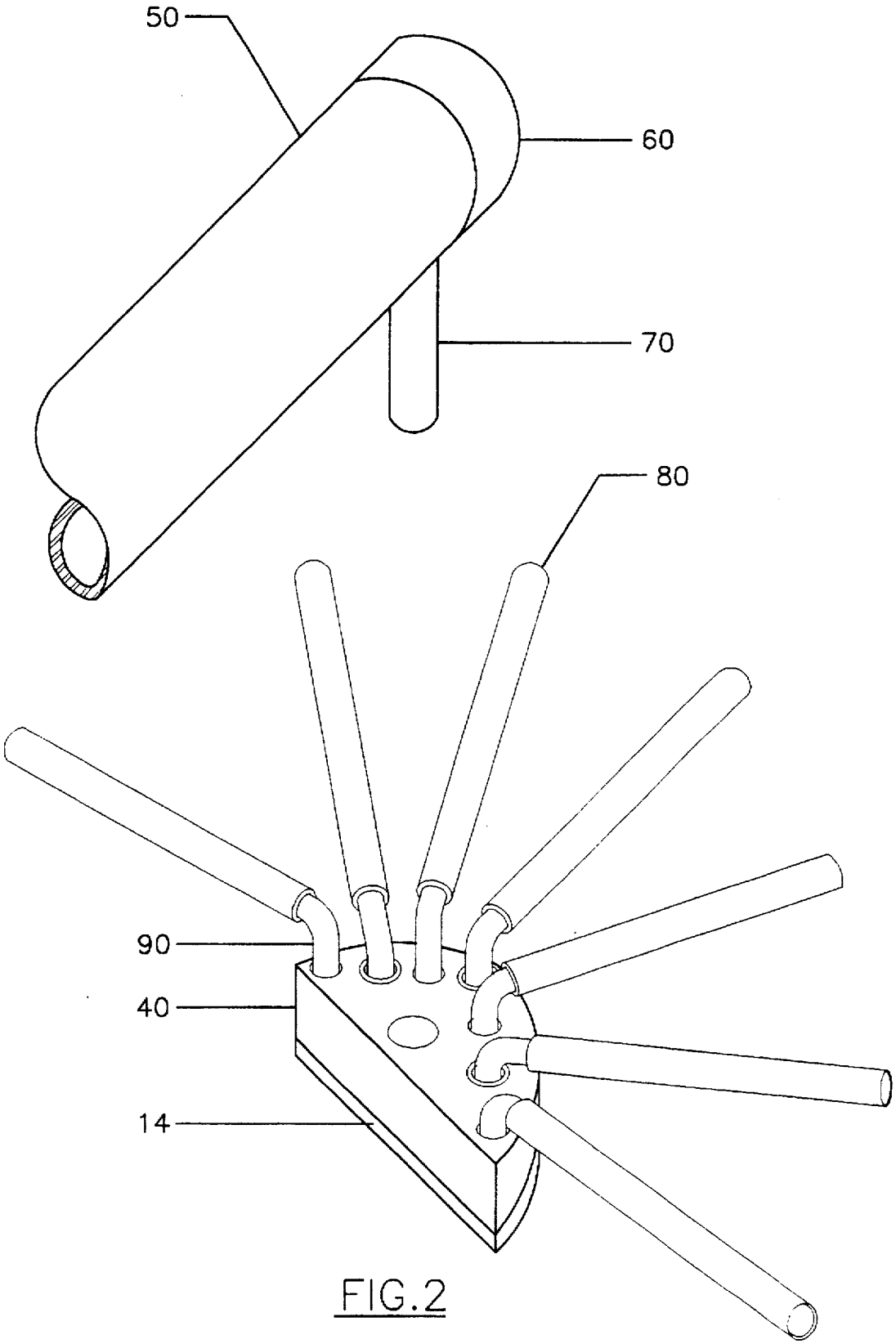
FIG. 2 illustrates in detail the plate to which the angular rib support shafts attach and further shows the relative location of the support shaft.

Referring to the drawings, FIG. 1 shows a support shaft 50, which is tubular shaped and extends from its vertical position into a horizontal position terminating at the center of the umbrella. FIG. 2 shows an end cap 60 attached to the support shaft 50. A pin 70 is fixed to the end of said shaft 50 in a vertical position.

Figure 3:
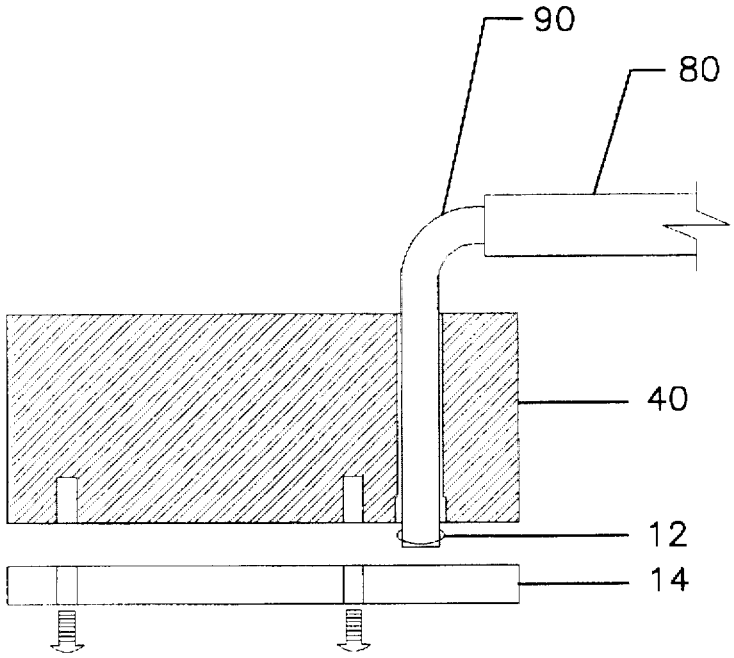
FIG. 3 shows a cross section of the plate for supporting ribs.
Figure 4:
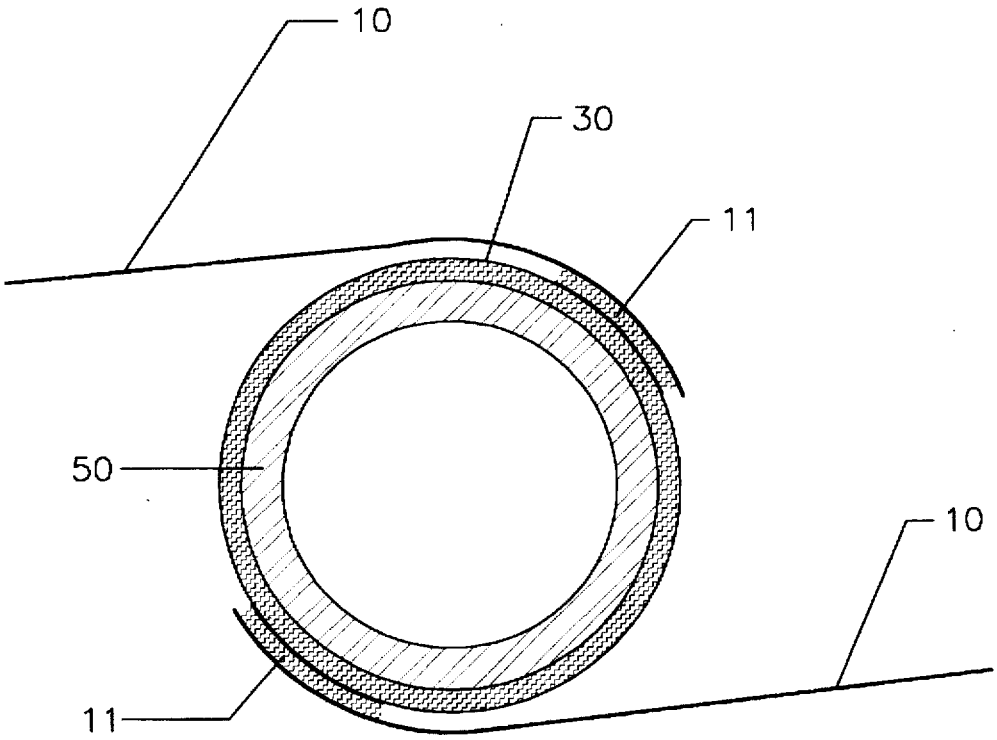
FIG. 4 shows a cross section of the horizontal support shaft and the location of fabric.

A plate 40 is attached to the pin 70 in a pivotal manner. The plate 40 has a series of vertical holes. The arrangement and location of such holes provides for alignment of all support ribs 20 in one direction, allowing the umbrella to be stored in a folded manner. FIG. 3 shows an angular rib supporting shaft 90 inserted into the plate 40.

A plurality of such shafts 90 (FIG. 2) are pivotally attached to the plate 40. Said plate 40 is shown in FIG. 3 with a single shaft 90 for clarity. Each said shaft 90 has a clip 12 attached to prevent the shaft 90 from detachment from the plate 40. A retainer plate 14 provides a stopping position for the shaft 90 and the pin 70. Fixed to the shaft 90 at its horizontal position is a hollow tube 80 accepting a fabric supporting rib 20 made of a flexible material. A covering fabric 10 (FIG. 1) is sewn in a tubular manner for inserting the support rib 20 and is without further attachment. The horizontal support shaft 50 has the loop portion of a hook and loop fastening means 30 wrapped around its outer surface to interact with a hook tape 11 sewn onto the fabric 10.

After removal of a protective cover, one end of the fabric 10 is pulled in a circular or radial direction. Each shaft 90 being pivotally connected to the plate 40, causes said plate 40 to rotate. Such rotation allows equal spacing for the supporting ribs 20. Ordinarily, one side of the covering fabric that is looped over the supporting shaft 50, stays attached. The opposite side of the fabric is simply pulled far enough to be looped and attached under the supporting shaft 50.

SUMMARY OF THE INVENTION

Thus the reader will see that this invention will provide an improved umbrella that offers price advantages due to lower manufacturing costs. Furthermore, it becomes evident that this type of umbrella is sturdy and highly reliable due to its few parts. In addition, it becomes apparent that the fastening system for the covering fabric prevents breakage. Detachment of the fabric from its support shaft will occur during strong winds. Immediate attention by the user is therefore not required. Its greatest advantage, however, is its compact size and lightness; it can be used in an array of applications: over hot tubs and tables, on campers and horse trailers or as a light reflector in a photographic environment.

The scope of the invention should not be determined by the embodiment described, but by the appended claim and its legal equivalent. However, it is recognized that those persons skilled in the art may make various changes, modifications, improvements and additions on the illustrated embodiments all without departing from the spirit and scope of the invention.

I claim:

1. An umbrella folding in a radial manner, comprising:

a horizontal support shaft;

a fabric cover associated with the fabric support ribs;

a plurality of support ribs which are made of a flexible material and which extend outward from an attached plate;

and wherein said plate attaches pivotally to said support shaft and to which a plurality of support ribs is connected, comprising a rotating assembly;

and wherein said support shaft defines the opening and closing of the fabric covering;

and wherein said support shaft functions as a supporting rib;

and wherein the fabric cover is fastened in a looped manner around said support shaft with a hook and loop fastener means, whereby in response to strong winds detachment occurs.

* * * * *